US006085542A

United States Patent [19]

Johnson et al.

[11] Patent Number: 6,085,542

[45] Date of Patent: Jul. 11, 2000

[54] REFRIGERATOR DOOR STORAGE SYSTEM

[75] Inventors: Warren F. Johnson, Galesburg; Jane Albert, Dahinda; Larry Edward Dietz, Galesburg; Douglas Alan Pohl, Rio, all of Ill.

[73] Assignee: Maytag Corporation, Newton, Iowa

[21] Appl. No.: 09/106,900

[22] Filed: Jun. 30, 1998

[51] Int. Cl.[7] ..... F25D 11/02

[52] U.S. Cl. ..... 62/441; 62/465; 312/292; 312/405

[58] Field of Search ..... 62/441, 465; 312/405, 312/292

[56] References Cited

U.S. PATENT DOCUMENTS

| | | | |
|---|---|---|---|
| 1,377,824 | 5/1921 | Forbes | 62/441 |
| 2,780,926 | 2/1957 | Sharpe | 62/441 |
| 2,942,438 | 6/1960 | Schmeling | 62/441 |
| 4,790,146 | 12/1988 | Mun et al. | 62/441 |

FOREIGN PATENT DOCUMENTS

| | | | |
|---|---|---|---|
| 53-14371 | 8/1979 | Japan | 62/441 |
| 63-46290 | 9/1989 | Japan | 62/441 |

*Primary Examiner*—Henry Bennett
*Assistant Examiner*—Melvin Jones
*Attorney, Agent, or Firm*—Everett G. Diederiks, Jr.

[57] ABSTRACT

A refrigerated product storage system incorporates first, second and third vertically spaced storage sections carried by a unitary support frame attached to an inner wall portion of a fresh food compartment door of a refrigerator. In the most preferred form of the invention, the storage system includes an uppermost dairy compartment, an intermediate chill compartment, and a lower, slidable drawer. The chill compartment is provided with a door which is pivotably mounted about a vertical, inboard pivot axis, with the door being formed with a cut-out handle portion adapted to be aligned with a passageway formed in a partition separating freezer and fresh food compartments of the refrigerator. With this construction, a supply of low temperature air is directed from the freezer compartment directly into the chill compartment through the cut-out handle portion. The door of the chill compartment is provided with a latching mechanism, preferably an over-center acting latching mechanism. In addition, the slidable drawer cooperates with a locking mechanism, which is preferably located at an inboard, visually obstructed location to restrict access to the contents of the slidable drawer.

39 Claims, 6 Drawing Sheets

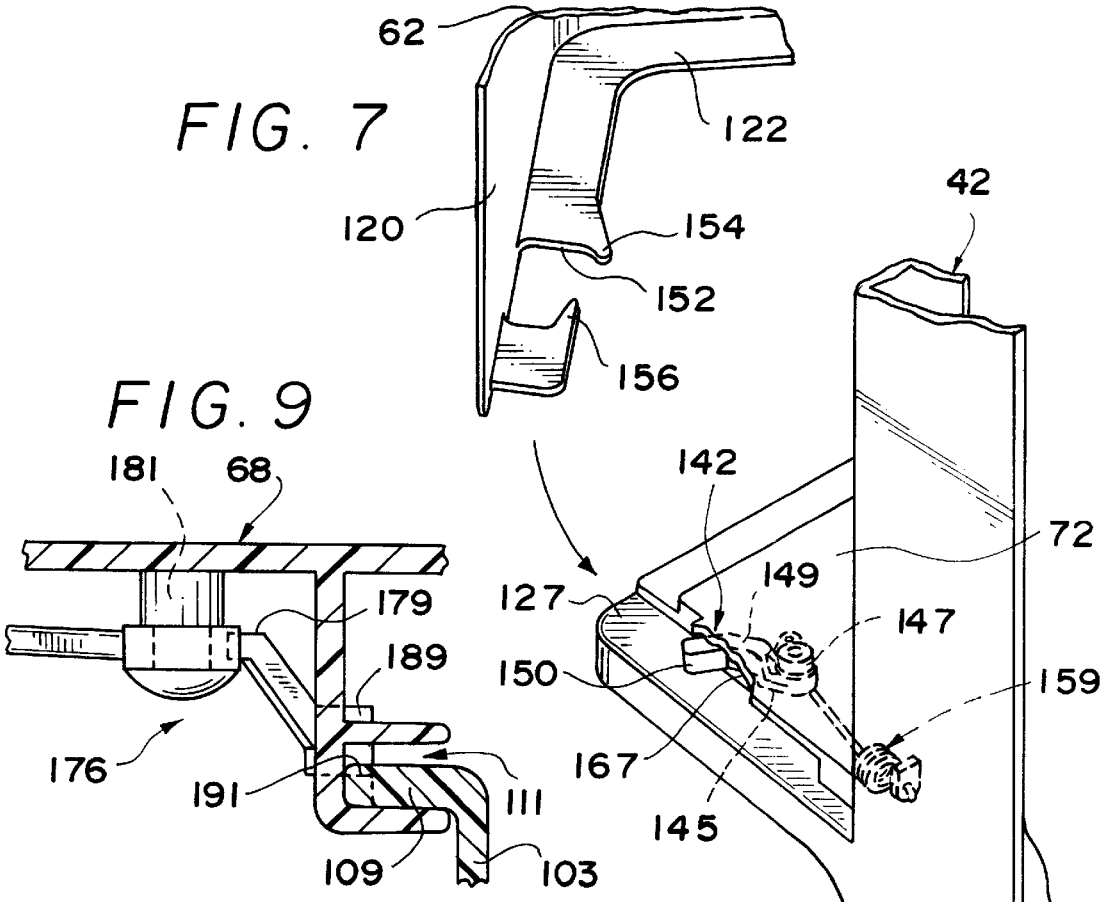
FIG. 7
FIG. 9
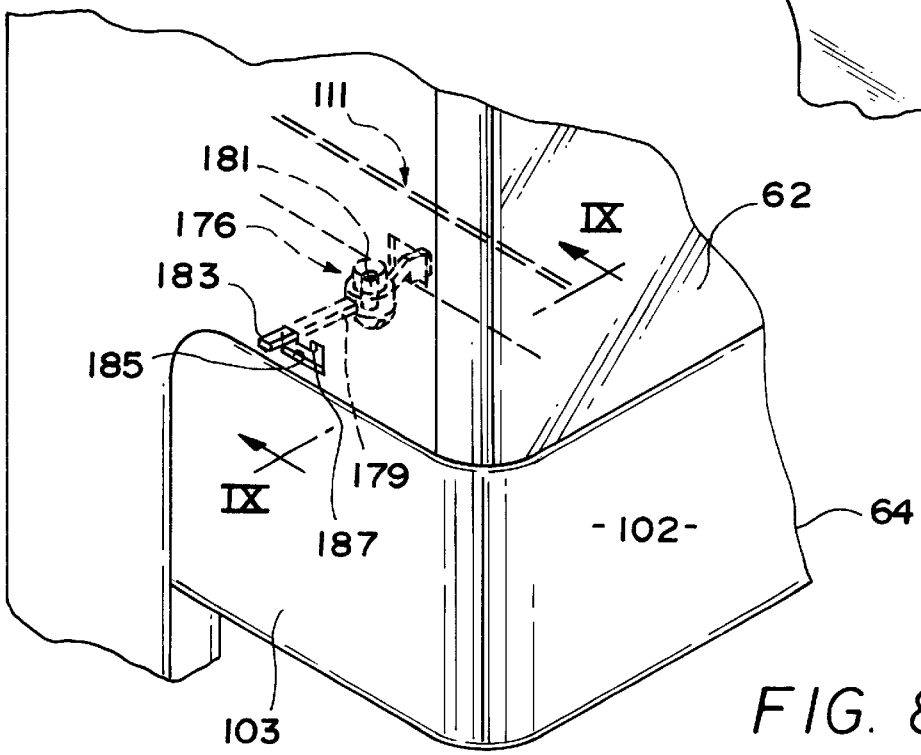
FIG. 8

REFRIGERATOR DOOR STORAGE SYSTEM

BACKGROUND OF THE INVENTION

1. Field of the Invention

The present invention pertains to the art of refrigerators and, more particularly, to a system for storing refrigerated products on an inner wall portion of a fresh food compartment door of a refrigerator.

2. Discussion of the Prior Art

In a refrigerator, it is highly desirable to enhance the ability to store products within a limited space. This space includes the inner surfaces of both the fresh food and freezer doors of the refrigerator. To this end, it is common to provide shelves and compartments on these inner surfaces. In recent years, some emphasis has been placed on increasing the ability to store a wide range of products, particularly on the door for the fresh food compartment, in order to free up space in the main compartment areas for additional products. For example, in the recent past, provisions have been made to store rather large beverage containers, including gallon milk cartons and the like, on the fresh food compartment door.

In general, the temperature attained along the inner surface of the fresh food compartment in such prior proposed arrangements is commensurate with the temperature in the remainder of the compartment. However, the desirability to provide a reduced temperature storage compartment for beverages and the like has also been recognized. For example, U.S. Pat. No. 5,100,213 is directed to forming a specialized chill compartment on the inner surface of the fresh food compartment door of a refrigerator and providing a slidable door for selectively accessing the compartment. To provide for a reduced temperature with the compartment, provisions are made to enable a flow of cooling air from the freezer into the specialized compartment. In general, this flow is directed through a mullion partition and into the chill compartment through a hole formed in a sidewall of a liner secured to the inner surface of the fresh food compartment door.

Although this patented arrangement provides a distinct compartment within the fresh food compartment wherein temperatures can be established for use in chilling beverages and the like below a temperature established within the remainder of the fresh food compartment, certain disadvantageous features are incorporated in this arrangement. For example, since the door for the chill compartment is arranged a central, vertical position upon the door, sliding of the chill compartment door to an open position makes food items placed in additional storage areas arranged above the chill compartment inaccessible. In addition, there are no provisions to assure that the chill compartment door will be properly closed when the fresh food door is closed. In fact, a detent arrangement is provided to hold the vertically sliding door in the open position such that a forced manual closure of the door is required. Enabling the chill door to remain open creates the potential for large beverage containers to fall from the shelf support of the chill compartment. Furthermore, this chill compartment arrangement has door guiding and other structure incorporated into the door liner which tends to represent a costly, low tolerance approach to the manufacturing of the overall door supported storage system.

Based on the above, there exists a need in the art for an improved refrigerated product storage system including a specialized, chill compartment defined on the inner wall portion of a fresh food compartment door of a refrigerator.

More specifically, there exists a need for a more versatile, cost effective and efficiently designed refrigerated product storage system for use in storing selected food items in different vertically spaced storage sections upon a fresh food compartment door at varying temperatures.

SUMMARY OF THE INVENTION

A refrigerated product storage system constructed in accordance with the present invention incorporates first, second and third vertically spaced storage sections carried by a unitary support frame adapted to be attached to an inner wall portion of a fresh food compartment door of a refrigerator. In a preferred embodiment of the invention, the storage system includes an uppermost dairy compartment, an intermediate chill compartment and a lower, slidable drawer. The frame is preferably secured to an upper section of a liner provided on the door, with additional, adjustable shelving being provided therebelow.

In the most preferred form of the invention, the frame is formed with a pair of vertically spaced, fixed shelves, with the upper shelf defining both the bottom of the dairy compartment and the top of the chill compartment. The lower shelf forms a base for the chill compartment and aids in supporting the slidable drawer. Intermediate the upper and lower fixed shelves and within the chill compartment is preferably arranged an additional shelf that can be shifted between a lower, in-use position and an upper, non-use or storage position. Preferably, this additional shelf includes a cut-out or reduced depth section which enables the chill compartment to accommodate rather large beverage containers or the like while maintaining the additional shelf in the in-use position.

The dairy compartment is provided with a cover which can be selectively rotated about a substantially horizontal axis to open and close the compartment. A second cover or door is provided for the chill compartment, with the chill compartment door being pivotally mounted for movement relative to the fresh food compartment door about a substantially vertical axis. The chill compartment door preferably includes an inner portion, an outer portion and a wrap around section. When closed, the chill compartment door extends across the inner wall portion of the fresh food compartment door and the wrap around section projects towards the inner wall portion in order to enclose the lower shelf.

In the most preferred form, the wrap around section is provided with a cut-out portion which defines both a handle for manually shifting the chill compartment door and an opening for directing a flow of cooling air into the chill compartment. More specifically, the fresh food and freezer compartments of the refrigerator are separated by a partition formed with an air passage. When the fresh food compartment door is closed, the cut-out portion of the chill compartment door is aligned with the air passage such that the chill compartment is specifically supplied with a flow of reduced temperature cooling air.

With this arrangement, the chill compartment can be accessed without the chill compartment door covering any of the other storage sections provided on the fresh food compartment door. By pivoting the chill compartment door about a substantially vertical axis located on an inboard side of the fresh food compartment door, the chill compartment door will be advantageously automatically closed upon closing of the fresh food compartment door. More specifically, if not fully closed upon closing of the fresh food compartment door, the chill compartment door will abut an inner liner portion of the fresh food compartment to assure complete and consistent closing of the chill compartment door. In addition, an over-center acting latching mechanism is preferably provided to maintain the chill compartment door in the closed position until a manual, external force is applied at the handle to re-open the chill compartment door.

The slidable drawer is preferably designed to incorporate a releasable locking unit located on an inboard side wall of the storage system. With this arrangement, the locking unit prevents the drawer from being inadvertently opened. Actually, since the locking unit cannot be easy located or operated by small children, medications and other items to be protected can be stored in the refrigerator with some degree of security against unauthorized access.

Additional objects, features and advantages of the refrigerated product storage system of the present invention will become more readily apparent from the following detailed description of a preferred embodiment thereof when taken in conjunction with the drawings wherein like reference numerals refer to corresponding parts in the several views.

BRIEF DESCRIPTION OF THE DRAWINGS

FIG. 7 is a partial, exploded view showing the interengaging structure of the latching unit;

FIG. 8 is a perspective view of a locking unit utilized in connection with a slidable drawer of the storage system; and FIG. 9 is an enlarged, partial cross-sectional view of the locking unit of FIG. 8.

DETAILED DESCRIPTION OF THE PREFERRED EMBODIMENT

Figure 1:
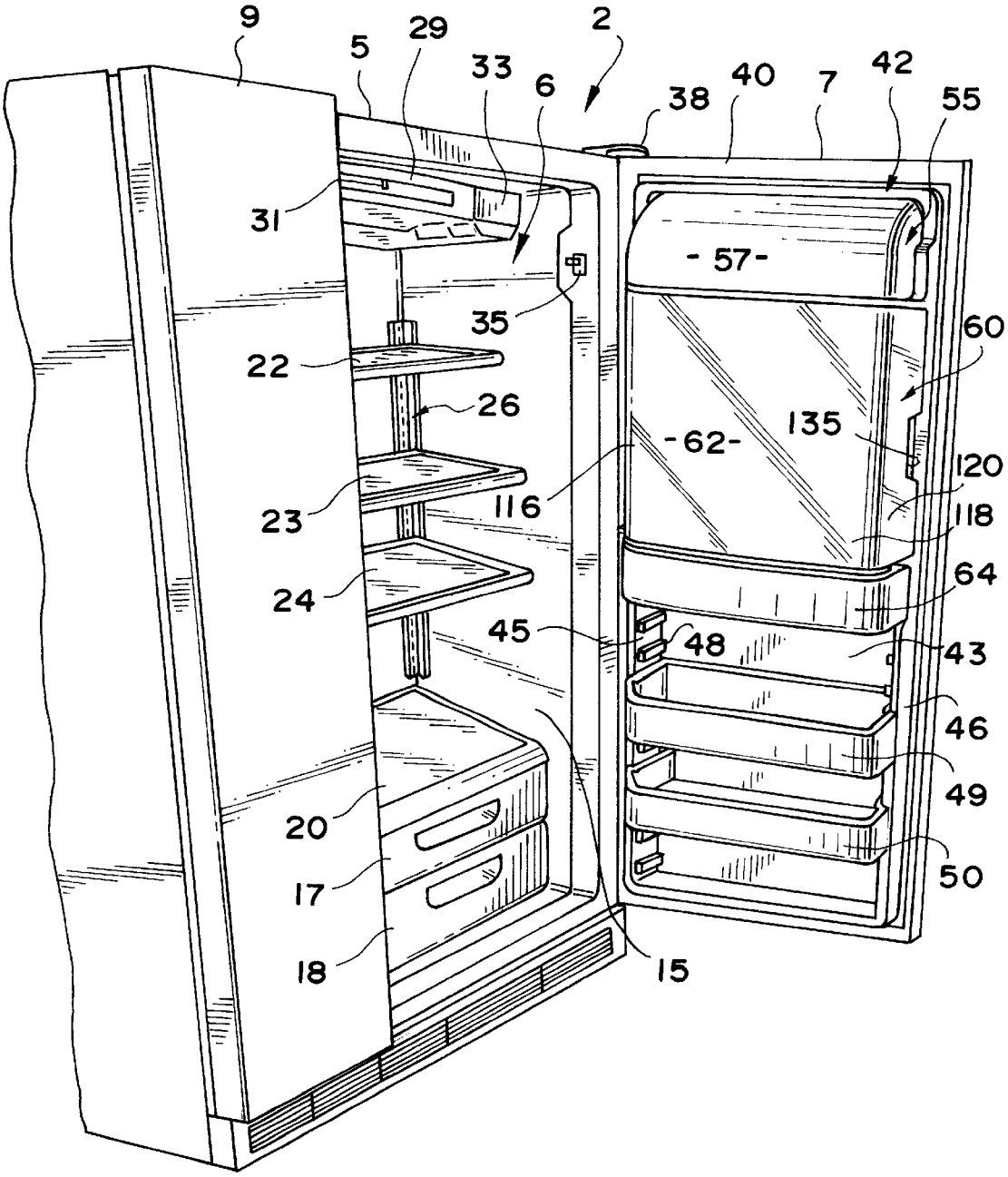
FIG. 1 is a perspective view of a portion of a side-by-side refrigerator incorporating the refrigerated product storage system of the present invention, with a chill compartment door of the system shown in a closed position.
Figure 3:
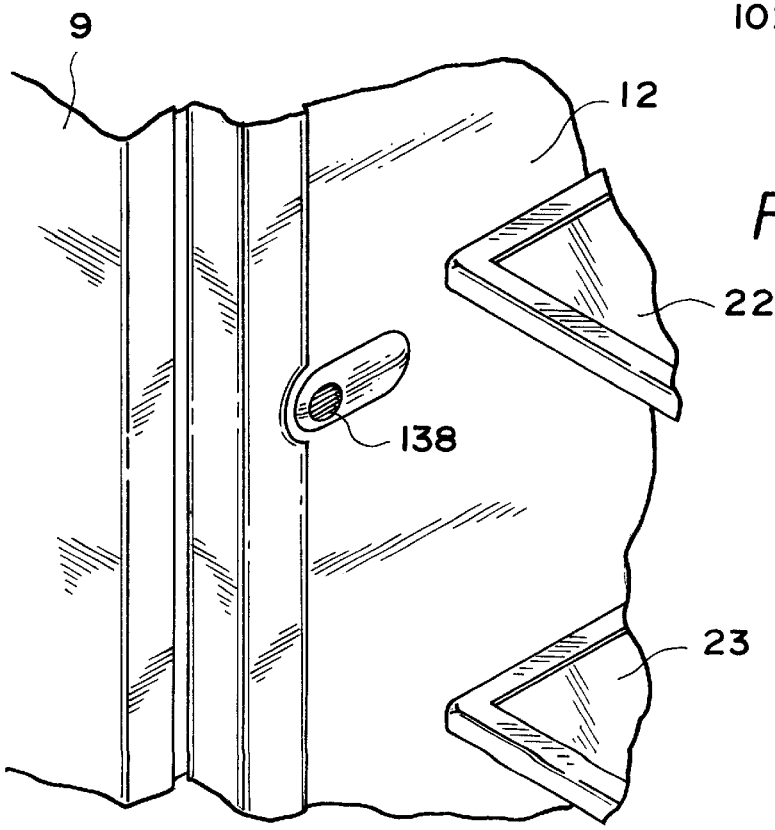
FIG. 3 is a partial view of an air flow passage formed in a partition separating freezer and fresh food compartments of the refrigerator of FIG. 1.

With initial reference to FIG. 1, a side-by-side refrigerator, generally indicated at 2, includes a cabinet shell 5 within which is defined a fresh food compartment 6 provided with a fresh food compartment door 7 and a freezer compartment (not visible) which can be accessed through a freezer compartment door 9. In a manner known in the art, fresh food compartment 6 is separated from the freezer compartment by means of a partition 12 which is best shown in FIG. 3. For the sake of completeness, fresh food compartment 6 is shown to include a liner 15 within which is positioned a pair of lower, slidable storage bins 17 and 18 arranged below a fixed shelf 20. Above shelf 20 is shown three cantilevered, vertically adjustable shelves 22–24 which are mounted upon rails, one of which is indicated at 26. Atop liner 15 is mounted a temperature control housing 29 including at least one manual control knob 31 for use in selectively setting the temperatures within refrigerator 2. Temperature control housing 29 also has associated therewith laterally spaced light housings, one of which is indicated at 33, for illuminating fresh food compartment 6 depending upon the position of a door activated switch 35. Again, this structure is being discussed for the sake of completeness and does not actually form part of the present invention. Instead, such structure is common in the art and therefore will not be more fully described herein.

Fresh food compartment door 7 is mounted for pivotal movement about a substantially vertical axis defined by an upper hinge 38 and a lower hinge (not shown). Fresh food compartment door 7 has an inner wall portion 40 upon which is provided the refrigerated product storage system 42 of the present invention. More specifically, inner wall portion 40 of fresh food compartment door 7 is secured thereto a molded liner 43 which defines a pair of laterally spaced, lower dike portions 45 and 46. Each of dike portions 45 and 46 is preferably formed with a plurality of inwardly projecting, molded rails 48 upon which can be removably supported product storing shelves, trays or bins, such as bucket-type bins 49 and 50 as illustrated in FIG. 1. As will be detailed more fully below, storage system 42 generally includes an upper dairy compartment 55 that is provided with a preferably clear plastic compartment cover 57, a chill compartment 60 arranged behind a chill compartment door 62 and a slidable drawer 64.

Figure 2:
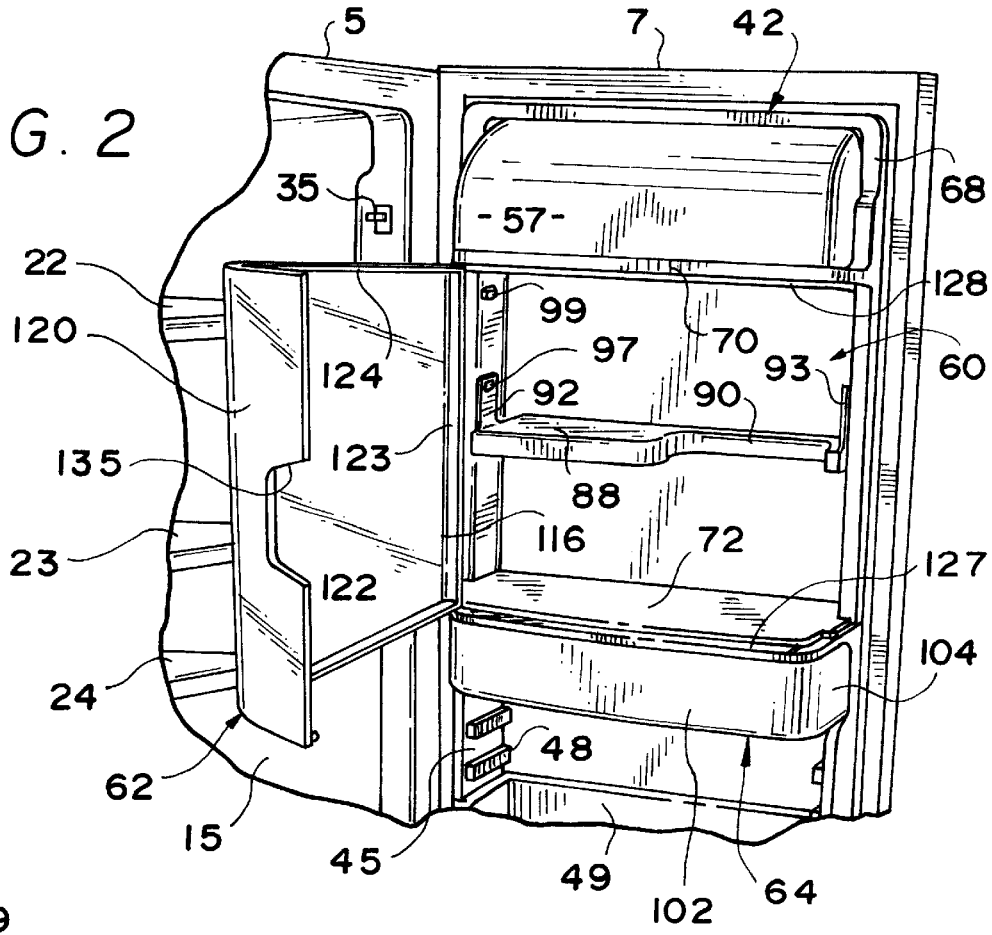
FIG. 2 is a partial perspective view, similar to that of FIG. 1, illustrating the storage system with the chill compartment door in an open position.
Figure 4A:
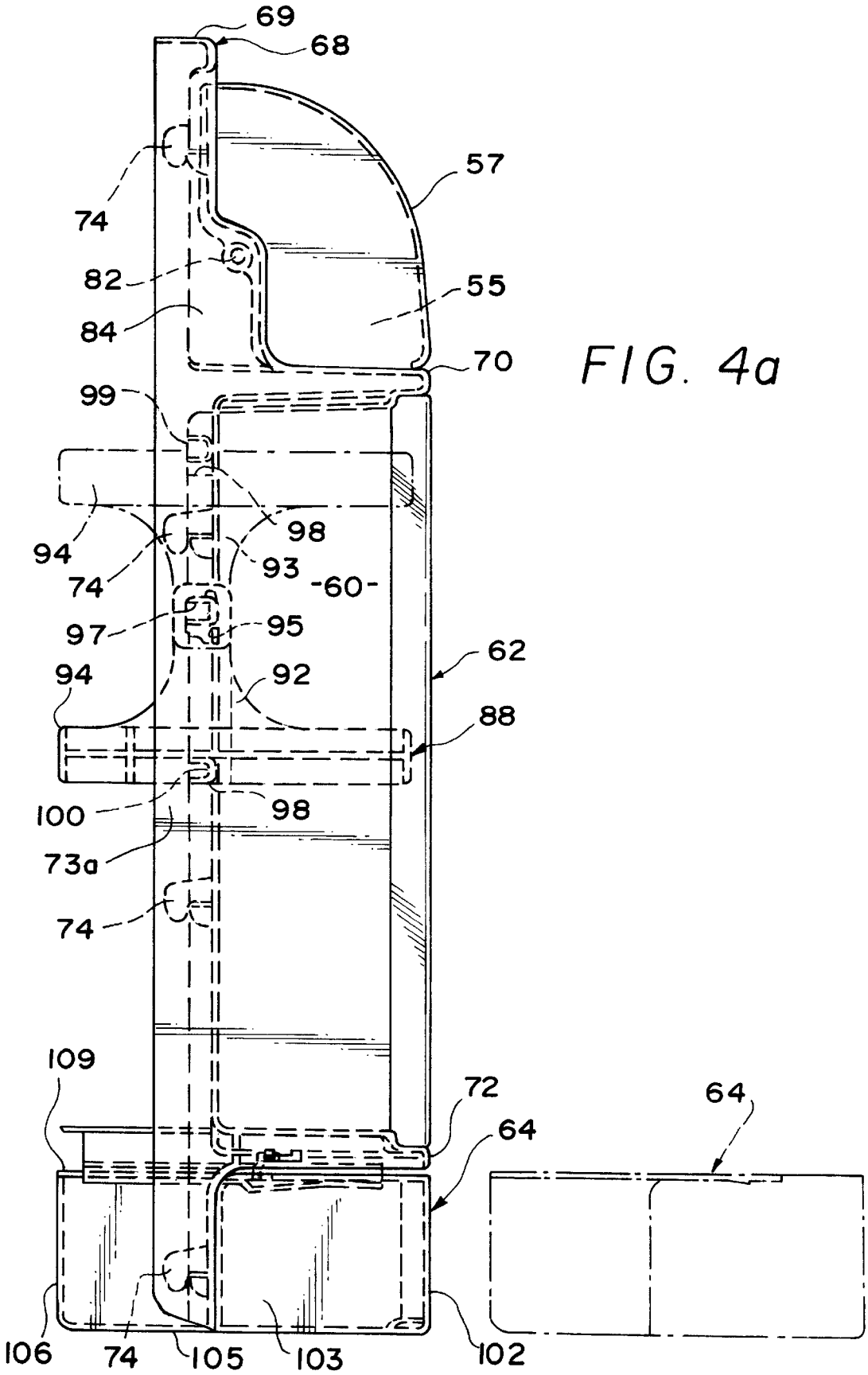
FIG. 4*a* is a side view generally illustrating an overall frame of the storage system of FIG. 1.
Figure 4B:
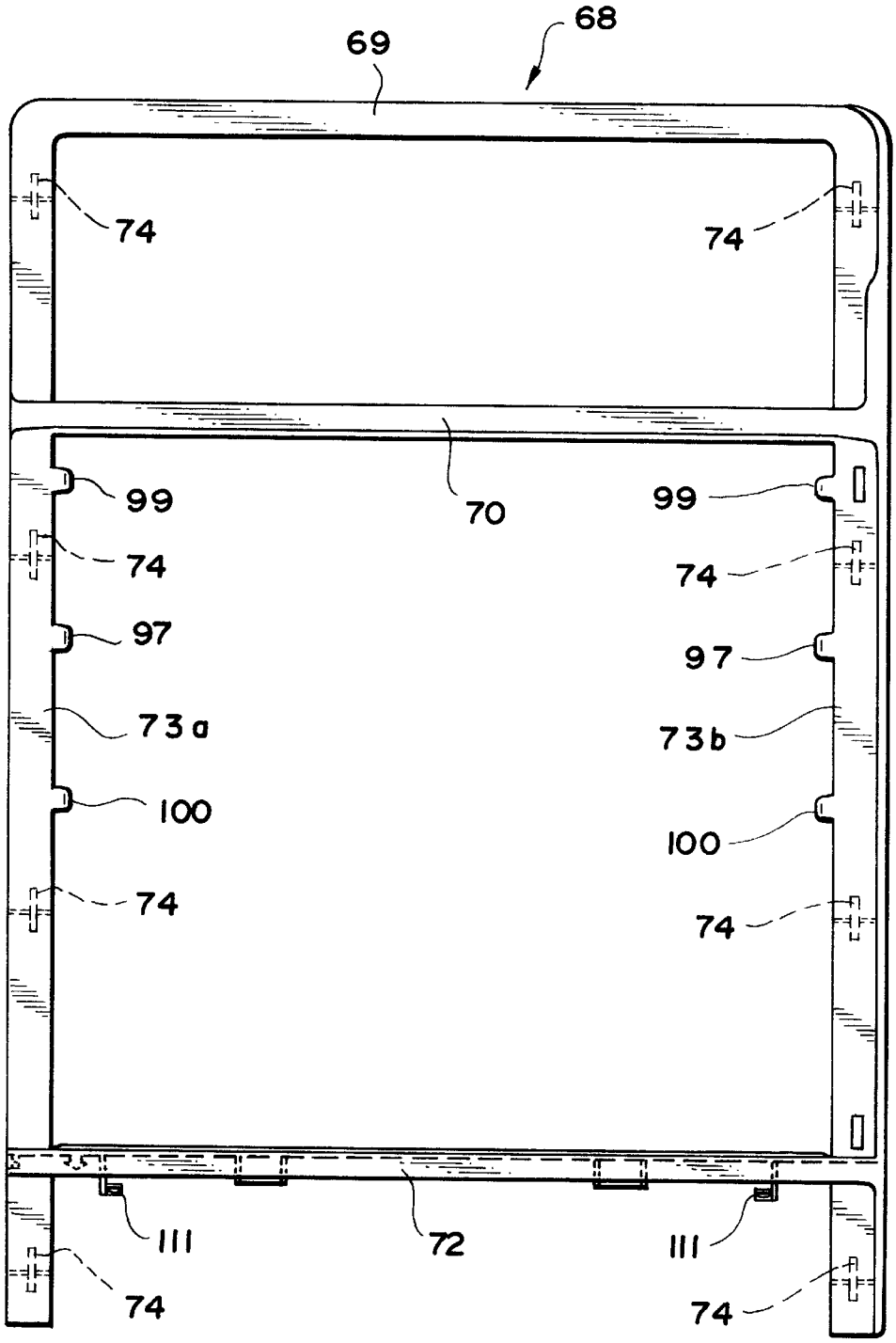
FIG. 4*b* is a front plan view of the frame of FIG. 4*a;*

Reference will now be particularly made to FIGS. 2, 4*a* and 4*b* in providing further details of the structure of storage system 42 as set forth in accordance with the preferred embodiment of the invention. Storage system 42 preferably incorporates a unitary frame 68 which is molded of a plastic material such as polypropylene. Frame 68 is shown to be integrally formed with a top rail 69, an upper fixed shelf 70, a lower fixed shelf 72 and first and second laterally spaced side rails 73*a* and 73*b* each of which is provided with a set of vertically spaced hooking elements 74. Although not particularly shown in the drawings, inboard and outboard ends of liner 43 are provided with vertically spaced slots, similar to the conventional types of slots provided in rails 26, within which are received hooking elements 74 in order to mount frame 68 upon inner wall portion 40 of fresh food compartment door 7. Of course, it should be understood that this is the preferred embodiment for suspending frame 68 upon door 7 and that various other arrangements within the scope of one of ordinary skill in the art could also be utilized without departing from the invention.

Cover 57 of upper dairy compartment 55 is mounted for rotational movement about a horizontal axis defined by laterally extending pins 82 which project from cover 57. More specifically, each pin 82 is rotatably mounted within a respective side panel portion 84 formed as part of frame 68. In this manner, cover 57 can be rotated to selectively provide access to upper dairy compartment 55 in a manner commensurate with somewhat typical dairy compartment arrangements provided on liners of conventional refrigerator doors. Preferably arranged between upper and lower fixed shelves 70 and 72, within chill compartment 60, is an intermediate shelf 88. As best shown in FIG. 2, intermediate shelf 88 is preferably formed with a reduced depth section 90 in order that large items to be refrigerated, such as large beverage containers, can be supported upon lower shelf 72 and project above intermediate shelf 88 within chill compartment 60. In the preferred embodiment shown, intermediate shelf 88 is preferably molded of plastic with a pair of integral hanging arms or brackets 92 and 93 extending from a base or platform 94. Each of the hanging brackets includes a generally rotated T-shape cut-out section 95 (see FIG. 4*a*) adapted to receive a respective support knob 97 carried by frame 68, and laterally spaced notches, one of which is shown at 98, are formed in base 94.

As clearly shown in FIG. 4*a*, each cut-out section 95 is vertically elongated such that intermediate shelf 88 can assume an in-use position shown in solid in FIGS. 2 and 4*a* and an upper, non-use storage position indicated by dotted lines in FIG. 4*a*. When arranged in the non-use position, notches 98 of intermediate shelf 88 receive a set of upper support knobs 99, while cut-out sections 95 of brackets 93 extend about support knob 97, in order to prevent intermediate shelf 88 from inadvertently dropping down or rotating out of the non-use position. To re-position intermediate shelf 88 into the in-use position, brackets 92 and 93 of intermediate shelf 88 must be initially lifted and then shifted laterally inwardly until each cut-out section 95 becomes disengaged from its respective support knob 97. Intermediate shelf 88 can then be removed, rotated end to end and re-inserted to assume the position shown in FIG. 2. In this position, notches 98 of intermediate shelf 88 receive lower knobs 100. As to further prevent undesirable disengagement between brackets 92 and 93 and support knobs 97, as well as warping of the brackets, an upper rear portion of each support knob 97 is preferably slotted to receive a tab portion (not labeled) of a respective bracket 92, 93 in order for intermediate shelf 88 to assume the position shown in FIG. 4*a*. In any event, it should be realized that cut-out section 95 of bracket 93 receives the left side support knob 97 when intermediate shelf 98 is in the non-use position and cut-out section 95 of bracket 92 receives the left side support knob 97 when intermediate shelf 88 assumes the in-use position.

Drawer 64 is preferably integrally molded of plastic and includes a front panel 102, side walls 103 and 104, a bottom panel 105 and a back panel 106. The uppermost portions of sidewalls 103 and 104 are formed with out-turned flanges 109 (also see FIG. 9) which are slidably received within a track 111. In this manner, drawer 64 can be readily shifted between a retracted position as shown in FIG. 2, an extended position, wherein drawer 64 preferably tilts slightly downward to increase the access of its contents, or completely removed from frame 68 as generally represented in dotted lines in FIG. 4*a*.

Reference will now be made to FIGS. 1, 2 and 5–7 in describing details of the preferred embodiment for chill compartment 60 and its associated door 62 which, in a manner similar to cover 57, is preferably formed of a transparent plastic material. As shown, chill compartment door 62 includes an inner portion 116, an outer portion 118 and a wrap around section 120. Given that refrigerator 2 constitutes a side-by-side refrigerator, wrap around section 120 generally constitutes a side wall portion of chill compartment door 62. About a substantial peripheral portion of chill compartment door 62 extends in-turned sections 122–124. As shown with respect to in-turned sections 122 and 124, these sections are adapted to be arranged juxtapose plateau portions 127 and 128 upon closing of chill compartment door 62 in order to enhance the positioning of door 62, as well as the support thereof. Chill compartment door 62 is actually pivotably mounted about a vertical axis at peripheral section 123 to enable movement of chill compartment door 62 between the closed position shown in FIG. 1 and the open position shown in FIG. 2.

In order to aid in grasping and shifting chill compartment door 62, wrap around section 120 is preferably formed with a cut-out section 135 which defines a handle for chill compartment door 62. When fresh food compartment door 7 is closed, cut-out section 135 of chill compartment door 62 is aligned with a passageway 138 extending through partition 12. With this arrangement, a supply of cold air will be directed from the freezer compartment, through passageway 138 and cut-out section 135 into chill compartment 60 when fresh food compartment door 7 is closed. Therefore, the items to be refrigerated within chill compartment 60 will be subjected to a lower temperature than the remainder of the products placed within fresh food compartment 6. It is envisioned that various types of beverages and the like which are often desirably served at a temperature lower than that maintained within the remainder of fresh food compartment 6 will be placed within chill compartment 60.

The mounting of chill compartment door 62 for pivotal movement about a generally vertical axis arranged at an inboard side of fresh food compartment door 7, i.e., a side of door 7 corresponding to that of the vertical axis defined, at least in part, by upper hinge 38, advantageously enables items placed within chill compartment 60 to be easily accessed, particularly since cut-out section 135 is located adjacent the handle opening side of fresh food compartment 6. The presence of wrap around section 120 also enhances the accessibility to within chill compartment 60. In addition, the movement of chill compartment door 62 in this fashion does not obstruct access to any other refrigerated products supported upon fresh food compartment door 7 and, particularly, the remainder of storage system 42. Furthermore, this arrangement advantageously provides for the automatic closing of chill compartment door 62 upon the closing of fresh food compartment door 7, even if chill compartment door 62 is inadvertently left ajar following access thereof.

As best illustrated in FIG. 2, with chill compartment door 62 in an open position, closing of fresh food compartment door 7 will cause a commensurate closing of chill compartment door 62 due to the abutment of chill compartment door 62 with structure of fresh food compartment 6. Therefore, if inadvertently left fully open, fresh food compartment door 62 will initially engage one or more of shelves 22–24 which will cause closing of chill compartment door 62 commensurate with the closing of fresh food compartment door 7. However, it is more likely that chill compartment door 62 will only be inadvertently left ajar such that it assumes the position shown in FIG. 5. In any event, even in this circumstance, the configuration of fresh food compartment 6 and chill compartment door 62 will cause wrap around section 120 to abut a portion of liner 15 at partition 12, preferably when fresh food compartment door 7 is approximately 1 degree of being fully closed, such that chill compartment door 62 will be forced, in a manner more fully described below, to assume the fully closed position commensurate with the closure of fresh food compartment door 7. Of course, once fully closed, chill compartment door 62 does not at all obstruct the opening and closing of fresh food compartment door 7.

It is also preferred in accordance with the present invention to incorporate a latching mechanism for use in selectively maintaining chill compartment door 62 in the closed position. In the preferred embodiment shown best in FIGS. 5–7, an over-center latching mechanism 142 is provided at lower fixed shelf 72. More specifically, latching mechanism 142 includes a pawl member 145 which has an associated hub 147 rotatably secured to an underside of lower fixed shelf 72. Pawl member 145 also includes an arm 149 having a bent terminal end section 150 which is adapted to be received within a cavity 152 formed at an outboard end portion of in-turned peripheral section 122. More specifically, cavity 152 is provided at a position along wrap around section 120 and the mouth of cavity 152 has one side formed with a protrusion 154 and another side formed with a projection 156. Hub 147 is interconnected with a tension spring 159 for use in biasing pawl member 145. More specifically, tension spring 159 includes a first end 161 attached adjacent hub 147 and a second, looped end 163 attached to a molded support mount 165 provided beneath lower fixed shelf 72.

Figure 5:
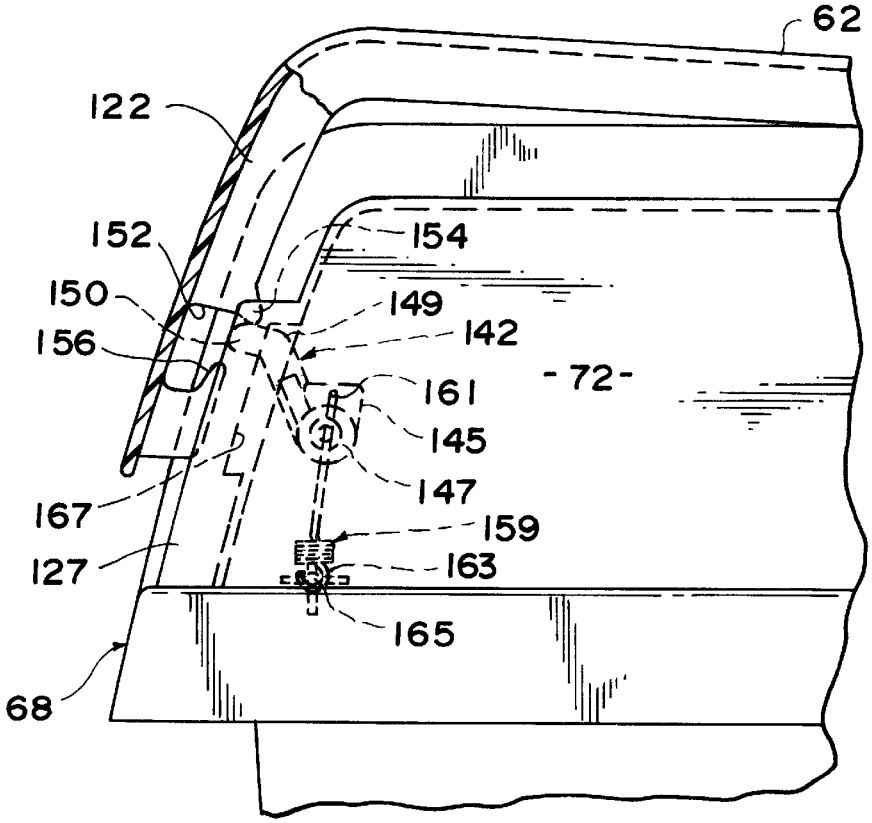
FIG. 5 is partial, cross-sectional top view illustrating a latching mechanism for the chill compartment door in an unlatched condition.
Figure 6:
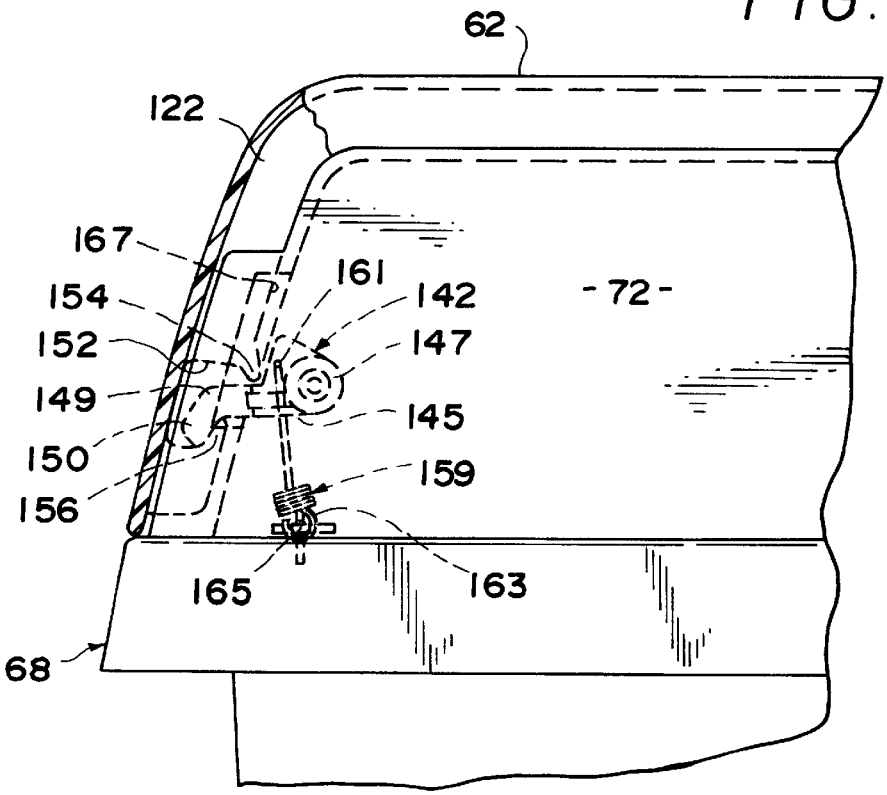
FIG. 6 is a view similar to FIG. 5, but illustrating the latching mechanism in a latched condition.

The terminal end section 150 of arm 149 projects through a slot 167 so as to be exposed along grooved plateau portion 127. When chill compartment door 62 is slightly ajar as shown in FIG. 5, terminal end section 150 is abutted by protrusion 154. In this position, tension spring 159 is extended and the longitudinal axis of spring 159 is arranged beyond the axis about which hub 147 is secured to lower fixed shelf 72 as clearly shown in FIG. 5. Therefore, in this position, pawl member 145 is retained in the position shown in FIG. 5 and prevented from rotating in the counterclockwise direction. However, as chill compartment door 62 is further closed, whether by direct manual force applied by a person accessing refrigerator 2 or through the abutment of chill compartment door 62 with liner 15, protrusion 154 will transmit a force upon terminal end section 150 to cause rotation of pawl member 145 in the counterclockwise direction. Once the axis associated with tension spring 159 extends over a top dead center position, tension spring 159 will force pawl member 145 to pivot in the counterclockwise direction as shown in these figures. Therefore, terminal end section 150 will project further into cavity 152 and will actually become lodged behind projection 156 such that rotation of pawl member 145 will cause chill compartment door 62 to become fully closed as illustrated in FIG. 6. When chill compartment door 62 is opened manually by a user positioning a hand within cut-out section 135 and causing pivoting of chill compartment door 62 about the inboard, substantially vertical pivot axis, projection 156 will be in engagement with terminal end section 150 of pawl member 145 such that pawl member 145 will be caused to rotate in the clockwise direction, against the biasing force of tension spring 159, until pawl member 145 again assumes the position shown in FIG. 5. At this point, chill compartment door 62 is fully released and pawl member 145 is maintained in the position of FIG. 5 due to the over-center action of latching mechanism 142. Therefore, based on the above, it should be readily apparent that latching mechanism 142 not only functions to retain chill compartment door 62 in the closed position, but also positively aids in closing the door.

In further accordance with the present invention, it is preferable to provide a unit or mechanism 176 for use in selectively locking slidable drawer 64. In accordance with the most preferred form of the invention, locking mechanism 176 is provided on an in-board end of storage system 42, i.e., at a side of storage system 42 adjacent the pivot axis for fresh food compartment door 7 and chill compartment door 62. In accordance with the most preferred form of the invention, locking mechanism 176 is arranged in the manner shown best in FIGS. 8 and 9. More specifically, locking mechanism 176 includes a toggle lever 179 rotatably mounted about a pin 181. Toggle lever 179 includes a first end 183 that projects through a slot 185 provided in frame 68. Slot 185 is shown to include a downwardly projecting, central tab 187, on either side of which first end 183 of toggle lever 179 can be retained. Toggle lever 179 also includes a second end 189 which can be shifted from a first or locking position, wherein second end 189 interferes with the ability of out-turned flange 109 to slide relative to track 111 as best shown in FIG. 9, and an unlocking position, wherein out-turned flange 109 is free to slide along track 111.

More specifically, when first end 183 of toggle lever 179 is arranged on the side of tab 187 shown in FIG. 8, second end 189 projects into a groove or recess 191 formed in out-turned flange 109. However, when first end 183 is shifted to an opposing side of tab 187 by initially being depressed, then linearly shifted and finally being permitted to shift upward, second end 189 becomes repositioned out of groove 191 and away from track 111 such that slidable drawer 64 is free to shift relative to unitary frame 68. Locking mechanism 176 is preferably positioned on a side opposite to the handle side for fresh food compartment door 7 and chill compartment door 62 in order to be inconspicuous. Therefore, locking mechanism 176 cannot be easily located by small children. In addition, the structure of locking mechanism 176 makes it difficult or impossible to be operated by infants in order that slidable drawer 64 can be advantageously utilized to store medications and other items that need to be refrigerated, yet require some degree of security against unauthorized access.

Based on the above detailed description of the preferred embodiment of the present invention, it should be apparent that storage system 42 incorporates first, second and third vertically spaced storage sections which are carried by a unitary support frame that can be readily attached to the inner liner of a refrigerator door. Integrating the various storage sections on a single unitary frame increases the overall efficiency of the unit from assembly and design standpoints. Therefore, storage system 42 represents a versatile, cost effective and efficiently designed refrigerated product storage system that can be used to store selected food items in different vertically spaced storage sections upon a fresh food compartment door at varying temperatures.

Although described with respect to a preferred embodiment of the invention, it should be readily understood that various changes and/or modifications can be made to the invention without departing from the spirit thereof. For instance, in the preferred embodiment, only a single latching mechanism 142 is provided. However, it should be readily recognized that a similar such mechanism could be provided at upper fixed shelf 70 either in lieu of or in addition to latching mechanism 142. In addition, various other types of latching arrangements commensurate in function to that of latching mechanism 142 could also be utilized in accordance with the present invention. The same is true with respect to locking mechanism 176. Instead, the mechanisms as described are presented as preferred embodiments and are therefore intended to be illustrative and not restrictive in accordance with the teachings of the present invention. Furthermore, although storage system 42 has been shown and described with respect to its application in a side-by-side refrigerator, it should be understood that the invention could also be applied to a top-mount type refrigerator wherein the wrap-around portion of the chill compartment door would actually function as a top wall and a cut-out portion would still be aligned with a mullion or partition separating the freezer and fresh food compartments to achieve the enhanced chilling within this compartment as discussed above. In any event, the invention is only intended to be limited by the scope of the following claims.

We claim:

1. In a refrigerator including a cabinet shell within which is defined fresh food and freezer compartments separated by a partition, with the fresh food and freezer compartments being selectively accessed by opening respective doors, having respective inner wall portions, pivotally mounted about substantially vertical axes to the cabinet shell, a refrigerated product storage system comprising:

a first product support shelf projecting from the inner wall portion of the fresh food compartment door; and a chill compartment door including an inner portion, an outer portion and a wrap around section, the inner portion of said chill compartment door being pivotally mounted for movement relative to the fresh food compartment door about a substantially vertical axis such that the chill compartment door is selectively movable between an open position, wherein access to the first shelf is provided, and a closed position, wherein the chill compartment door extends across the inner wall portion of the fresh food compartment door and the wrap around section projects towards the inner wall portion of the fresh food compartment door to enclose the first shelf within a chill compartment.

2. The refrigerated product storage system according to claim 1, wherein the wrap around section of the chill compartment door is formed with a handle for manually shifting the chill compartment door.

3. The refrigerated product storage system according to claim 2, wherein the handle is defined by a cut-out portion of the wrap around section.

4. The refrigerated product storage system according to claim 3, further comprising: an air passage formed in the partition, said cut-out portion being aligned with the air passage when the fresh food compartment door is closed in order to deliver a supply of cooling air from the freezer compartment to within the chill compartment.

5. The refrigerated product storage system according to claim 1, further comprising: a second product support shelf mounted within the chill compartment.

6. The refrigerated product storage system according to claim 5, wherein the second shelf is mounted for vertical repositioning within the chill compartment.

7. The refrigerated product storage system according to claim 6, wherein the second shelf is adapted to be selectively positioned within the chill compartment in one of a lower, in-use position and an upper, non-use position.

8. The refrigerated product storage system according to claim 1, further comprising: a storage system frame secured to the inner wall portion of the fresh food compartment door, said chill compartment door being directly, pivotally attached to the storage system frame.

9. The refrigerated product storage system according to claim 1, further comprising: a dairy compartment, including a rotatably mounted cover, positioned vertically above the chill compartment.

10. The refrigerated product storage system according to claim 9, further comprising: a slidable storage drawer arranged vertically below the chill compartment.

11. The refrigerated product storage system according to claim 1, further comprising: a mechanism for latching the chill compartment door in said closed position.

12. The refrigerated product storage system according to claim 11, wherein said latching mechanism includes a pawl member pivotally attached to said first shelf, said pawl member being adapted to be received within a cavity formed in said chill compartment door.

13. The refrigerated product storage system according to claim 12, wherein said latching mechanism further includes a over-center acting spring which is interconnected to said pawl member and biases said pawl member into one of latching and release positions.

14. The refrigerated product storage system according to claim 12, wherein said cavity has an associated mouth into which said pawl member projects, said mouth being formed with a projection which engages said pawl member upon closing of the chill compartment door and a protrusion which engages said pawl member upon opening of the chill compartment door.

15. In a refrigerator including a cabinet shell within which is defined fresh food and freezer compartments separated by a partition, with the fresh food and freezer compartments being selectively accessed by opening respective doors, having respective inner wall portions, pivotally mounted about substantially vertical axes to the cabinet shell, a refrigerated product storage system comprising:

a first product support shelf projecting from the inner wall portion of the fresh food compartment door;

a chill compartment door including an inner portion and an outer portion, the inner portion of said chill compartment door being pivotally mounted for movement relative to the fresh food compartment door about a substantially vertical axis such that the chill compartment door is selectively movable between an open position, wherein access to the first shelf is provided, and a closed position, wherein the chill compartment door extends across the inner wall portion of the fresh food compartment to enclose the first shelf within a chill compartment, said chill compartment door being formed with a cut-out portion; and an air passage formed in the partition, said cut-out portion being aligned with the air passage when the fresh food compartment door is closed in order to deliver a supply of cooling air from the freezer compartment to within the chill compartment.

16. The refrigerated product storage system according to claim 15, further comprising: a storage system frame mounted to the inner wall portion of the fresh food compartment door, said chill compartment door being directly, pivotally attached to the storage system frame.

17. The refrigerated product storage system according to claim 15, further comprising: a dairy compartment, including a rotatably mounted cover, positioned vertically above the chill compartment.

18. The refrigerated product storage system according to claim 17, further comprising: a slidable storage drawer arranged vertically below the chill compartment.

19. The refrigerated product storage system according to claim 15, further comprising: a mechanism for latching the chill compartment door in said closed position.

20. The refrigerated product storage system according to claim 19, wherein said latching mechanism includes a pawl member pivotally attached to said first shelf, said pawl member being adapted to be received within a cavity formed in said chill compartment door.

21. The refrigerated product storage system according to claim 20, wherein said latching mechanism further includes a over-center acting spring which is interconnected to said pawl member and biases said pawl member into one of latching and release positions.

22. The refrigerated product storage system according to claim 21, wherein said cavity has an associated mouth into which said pawl member projects, said mouth being formed with a projection which engages said pawl member upon closing of the chill compartment door and a protrusion which engages said pawl member upon opening of the chill compartment door.

23. The refrigerated product storage system according to claim 15, wherein said chill compartment door further includes a wrap around section at the outer portion thereof, said cut-out portion being formed in the wrap around section.

24. In a refrigerator including a cabinet shell within which is defined fresh food and freezer compartments separated by a partition, with the fresh food and freezer compartments being selectively accessed by opening respective doors, each of which has an inner wall portion, pivotally mounted about substantially vertical axes to the cabinet shell, a refrigerated product storage system comprising:

a storage system frame mounted to the inner wall portion of the fresh food compartment door, said storage frame being divided into at least first and second distinct storage sections;

a first product support shelf carried by the storage frame, with the first shelf separating the first and second storage sections;

a second product support shelf carried by the storage frame at a lower end of the second storage section; and first and second storage section covers, with the first cover being adapted to selectively extend across products placed upon the first shelf and the second cover being adapted to extend across products placed on the second shelf, each of the first and second covers being movably supported by the storage frame.

25. The refrigerated product storage system according to claim 24, wherein the first storage section constitutes a dairy compartment, said first cover being rotatably mounted about a substantially horizontal axis.

26. The refrigerated product storage system according to claim 25, wherein the second storage section constitutes a chill compartment, said second cover being pivotally mounted about a substantially vertical axis.

27. The refrigerated product storage system according to claim 26, wherein the second cover comprises a chill compartment door including an inner portion, an outer portion and a wrap around section, the inner portion of said chill compartment door being pivotally mounted for movement relative to the fresh food compartment door about a substantially vertical axis such that the chill compartment door is selectively movable between an open position, wherein access to the second shelf is provided, and a closed position, wherein the chill compartment door extends across the inner wall portion of the fresh food compartment door and the wrap around section projects towards the inner wall portion of the fresh food compartment door to enclose the second shelf within a chill compartment.

28. The refrigerated product storage system according to claim 27, wherein the wrap around section of the chill compartment door is formed with a handle for manually pivoting the chill compartment door.

29. The refrigerated product storage system according to claim 28, wherein the handle is defined by a cut-out portion of the wrap around section.

30. The refrigerated product storage system according to claim 29, further comprising: an air passage formed in the partition, said cut-out portion being aligned with the air passage when the fresh food compartment door is closed in order to deliver a supply of cooling air from the freezer compartment to within the chill compartment.

31. The refrigerated product storage system according to claim 27, further comprising: a third product support shelf mounted within the chill compartment.

32. The refrigerated product storage system according to claim 31, wherein the third shelf is mounted for vertical repositioning within the chill compartment.

33. The refrigerated product storage system according to claim 32, wherein the third shelf is adapted to be selectively positioned within the chill compartment in one of a lower, in-use position and an upper, non-use position.

34. The refrigerated product storage system according to claim 33, wherein the third shelf projects on both sides of a vertical plane defined by the storage frame when in either of the in-use or non-use positions.

35. In a refrigerator including a cabinet shell within which is defined fresh food and freezer compartments separated by a partition, with the fresh food and freezer compartments being selectively accessed by opening respective doors, each of which has an inner wall portion, pivotally mounted about substantially vertical axes to the cabinet shell, a refrigerated product storage system comprising:

first, second and third vertically spaced storage sections arranged on the inner wall portion of the fresh food compartment door, at least one of said storage sections being defined by a slidable drawer; and a locking unit for preventing unauthorized opening of the slidable drawer.

36. The refrigerated product storage system according to claim 35, wherein said slidable drawer has an inboard side and an outboard side, with the inboard side being located closer to the vertical axis about which the fresh food compartment door pivots than the outboard side, said locking unit being located on the inboard side of the slidable drawer.

37. The refrigerated product storage system according to claim 36, wherein the locking unit comprises a lever shiftably mounted relative to the slidable drawer for movement between a locking position, wherein the slidable drawer is prevented from shifting relative to the fresh food compartment door, and an unlocking position, wherein the slidable drawer can be freely opened.

38. The refrigerated product storage system according to claim 36, further comprising: a storage system frame mounted to the inner wall portion of the fresh food compartment door, each of the first, second and third vertically spaced storage sections being carried by the storage system frame.

39. In a refrigerator including a cabinet shell within which is defined fresh food and freezer compartments separated by a partition, with the fresh food and freezer compartments being selectively accessed by opening respective doors, each of which has an inner wall portion, pivotally mounted about substantially vertical axes to the cabinet shell, a refrigerated product storage system comprising:

a storage system frame mounted to the inner wall portion of the fresh food compartment door, said storage frame being divided into at least first, second and third vertically spaced and distinct storage sections arranged on the inner wall portion of the fresh food compartment door, at least one of said storage sections being defined by a slidable drawer;

a locking unit for preventing unauthorized opening of the slidable drawer;

a first product support shelf carried by the storage frame and projecting from the inner wall portion of the fresh food compartment door, with the first shelf separating the first and second storage sections;

a second product support shelf carried by the storage frame at a lower end of the second storage section;

first and second storage section covers, with the first cover being adapted to selectively extend across products placed upon the first shelf and the second cover being adapted to extend across products placed on the second shelf, each of the first and second covers being movably supported by the storage frame, said first cover constituting a chill compartment door including an inner portion, an outer portion and a wrap around section, the inner portion of said chill compartment door being pivotally mounted for movement relative to the fresh food compartment door about a substantially vertical axis such that the chill compartment door is selectively movable between an open position, wherein access to the first shelf is provided, and a closed position, wherein the chill compartment door extends across the inner wall portion of the fresh food compartment door and the wrap around section projects towards the inner wall portion of the fresh food compartment door to enclose the second shelf within a chill compartment, said chill compartment door being formed with a cut-out portion; and an air passage formed in the partition, said cut-out portion being aligned with the air passage when the fresh food compartment door is closed in order to deliver a supply of cooling air from the freezer compartment to within the chill compartment.

* * * * *